US009814276B2

(12) United States Patent
James et al.

(10) Patent No.: US 9,814,276 B2
(45) Date of Patent: Nov. 14, 2017

(54) CONVERTIBLE GARMENT AND METHOD OF CONVERTING SAME

(71) Applicant: G-III Apparel Group, Ltd., New York, NY (US)

(72) Inventors: Timothy James, Long Island City, NY (US); Marina Voloshina, Brooklyn, NY (US); Shana Cohen, New York, NY (US)

(73) Assignee: G-III APPAREL GROUP, LTD., New York, NY (US)

( * ) Notice: Subject to any disclaimer, the term of this patent is extended or adjusted under 35 U.S.C. 154(b) by 97 days.

(21) Appl. No.: 14/580,876

(22) Filed: Dec. 23, 2014

(65) Prior Publication Data

US 2016/0174621 A1 Jun. 23, 2016

(51) Int. Cl.
*A41D 23/00* (2006.01)
*A41D 15/00* (2006.01)

(52) U.S. Cl.
CPC ..... *A41D 23/00* (2013.01); *A41D 15/00* (2013.01)

(58) Field of Classification Search
CPC ..... A41D 1/04; A41D 23/00; A41D 15/00; A41D 15/04; A41D 2400/38; A41D 2023/004
USPC ..... 2/102, 207, 88, 209, 265
See application file for complete search history.

(56) References Cited

U.S. PATENT DOCUMENTS 891,166 A * 6/1908 Harrison ..... A41D 23/00 2/91
1,509,296 A * 9/1924 Hopewell ..... A41D 15/00 2/88
1,610,799 A * 12/1926 Lack ..... A41D 3/02 2/69
1,652,982 A * 12/1927 Grean ..... A41D 23/00 2/91
1,703,744 A * 2/1929 Montgomery ..... A41D 3/02 2/88
2,067,850 A * 1/1937 Kaufman ..... A41D 1/04 2/102

(Continued)

OTHER PUBLICATIONS

International Search Report and Written Opinion of the Searching Authority dated Feb. 19, 2016 in the corresponding International Application No. PCT/US15/67376. (9 pages, in English).

(Continued)

*Primary Examiner* — Katherine Moran
*Assistant Examiner* — James Heracklis
(74) *Attorney, Agent, or Firm* — Buchanan Ingersoll & Rooney PC

(57) ABSTRACT

A convertible garment and a method of converting a convertible garment is disclosed. A convertible garment includes a piece of fabric possessing a periphery, and a plurality of fasteners disposed on the piece of fabric along the periphery at substantially regular intervals. One of the plurality of fasteners is configured to fasten to each of the other fasteners to form armholes. The convertible garment is configured to adopt a first configuration in which the fasteners are not fastened to one another so that the convertible garment is wearable as a scarf. The convertible garment is configured to adopt a second configuration in which one of the plurality of fasteners is fastened to each of the other fasteners so that the convertible garment is wearable as a vest.

6 Claims, 3 Drawing Sheets

(56) References Cited

U.S. PATENT DOCUMENTS 2,303,383 A * 12/1942 Norton ..... A41D 1/04 2/102
2,308,449 A 1/1943 Katzman
2,603,788 A * 7/1952 Page ..... A41D 1/04 2/106
2,669,721 A * 2/1954 Koch ..... A41D 1/22 2/105
2,804,626 A * 9/1957 Rossiter ..... A41D 23/00 2/207
2,806,222 A * 9/1957 Carpenter ..... A41D 1/22 2/207
2,870,448 A * 1/1959 Rosenthal ..... A41D 1/04 2/102
3,013,274 A * 12/1961 Dike ..... A41D 7/008 2/67
3,286,276 A * 11/1966 Calisch ..... A41D 23/00 2/207
3,360,802 A 1/1968 Kasamatsu
3,590,864 A * 7/1971 Vechesloff ..... A41D 15/04 135/115
3,605,121 A * 9/1971 Suzuki ..... A41D 23/00 2/207
4,142,264 A * 3/1979 Whiting ..... A47G 9/066 2/69.5
4,199,822 A * 4/1980 Vasquez ..... A41D 1/18 2/106
4,217,662 A * 8/1980 Buchman ..... A47G 9/066 2/69.5
4,240,159 A * 12/1980 Wrightson ..... A47G 9/066 2/69
4,258,439 A * 3/1981 York ..... A41D 15/00 2/69.5
4,797,953 A * 1/1989 Dameron ..... A41D 1/205 2/102
4,870,707 A * 10/1989 Hayes ..... A41D 23/00 2/144
5,875,492 A * 3/1999 Moss ..... A41D 3/08 2/82
6,175,964 B1 * 1/2001 Adler ..... A41D 15/00 2/207
6,327,712 B1 * 12/2001 Armstrong ..... A41D 1/205 2/104
6,655,387 B2 * 12/2003 Leslie ..... A45D 44/08 132/207
7,178,185 B1 * 2/2007 Nattler ..... A41D 15/04 2/84
D583,535 S * 12/2008 George ..... D2/864
7,467,423 B1 * 12/2008 Tawfik ..... A41D 23/00 2/207
D590,649 S * 4/2009 Fackrell ..... D6/611
8,464,374 B1 * 6/2013 Thayer ..... A47G 9/08 2/69
8,468,612 B1 * 6/2013 Galloway ..... A41D 23/00 2/207
D695,490 S * 12/2013 Lake ..... D2/502
8,726,421 B2 * 5/2014 Alvarez ..... A41D 13/0512 2/207
2002/0156407 A1 * 10/2002 Estep ..... A61F 5/3746 602/4
2004/0237167 A1 * 12/2004 Curry ..... A41D 3/08 2/88
2005/0039241 A1 * 2/2005 Khan ..... A41D 13/00 2/86
2005/0044606 A1 * 3/2005 Flanagan-Frazier ... A41D 7/006 2/69
2008/0282444 A1 * 11/2008 Lin ..... A41D 3/08 2/88
2009/0222969 A1 * 9/2009 Townsend ..... A41D 23/00 2/88
2009/0260127 A1 * 10/2009 Prezgar ..... A41D 15/00 2/88
2010/0146680 A1 * 6/2010 Cuoco ..... A41D 3/08 2/84
2011/0258749 A1 * 10/2011 Hibbs ..... A41D 3/08 2/84
2011/0305866 A1 * 12/2011 Stowe ..... A47G 9/062 428/100
2011/0314584 A1 * 12/2011 Wang ..... A41D 7/008 2/69
2011/0314586 A1 12/2011 Greenberg
2012/0079644 A1 * 4/2012 Benderradji ..... A41D 15/007 2/207
2012/0137416 A1 * 6/2012 Taul ..... A41D 23/00 2/461
2012/0204323 A1 * 8/2012 Park ..... A41D 23/00 2/202
2012/0317702 A1 * 12/2012 Daly ..... A41D 23/00 2/265
2013/0042381 A1 2/2013 Yonover
2013/0291279 A1 * 11/2013 Jensen ..... A41D 1/22 2/69
2014/0259334 A1 * 9/2014 Mitchell ..... A41D 23/00 2/461
2016/0174621 A1 * 6/2016 James ..... A41D 15/00 2/102

OTHER PUBLICATIONS

"Creating Bits of Envy" (Blogspot) Feb. 2, 2014. Retrieved from the internet on Feb. 9, 2016. <www.creatingbitsofenvy.blogspto.com?>(35 pages, in English).
"Multi-Way Sweater Scarf" Vivi Designs Inc (Vivi); Dec. 6, 2013; Retrieved from the Internet on Feb. 9, 2016. <http://www.vividesigninc.com/includes/62500Brochure.pdf> (7 pages, in English).
"Frugal Fashion—Wear your scarf as a Vest" (Couponing 101); Apr. 29, 2013; Retrieved from the internet on Feb. 9, 2016 <http://www.couponing101.com/frugal-fashion-wear-your-scarf-as-a-vest/> (6 pages, in English).

* cited by examiner

CONVERTIBLE GARMENT AND METHOD OF CONVERTING SAME

TECHNICAL FIELD

The present disclosure relates to a convertible garment and a method of converting a convertible garment, including, more particularly, a scarf configured to convert to a vest and a method of converting the same.

BACKGROUND INFORMATION

Scarves are typically worn around the neck or head. Scarves can also be worn in a variety of ways, including as a vest. Conventionally, a scarf can be worn as a vest by tying two adjacent corners of the scarf to a middle section of the side separating them, thereby creating two openings for a user's arms. This method however presents numerous problems. For example, wearing a scarf as a vest in this manner requires forming a knot, which can be cumbersome to a user wearing the scarf. Moreover, knotting the scarf can damage the material over time. It can also be difficult for a user to tie and untie the scarf as a vest in a desired way in a repeatable manner.

Therefore, there is a need for a garment that can be worn as a scarf and that can be converted to a vest in a repeatable manner, without a knot, and with minimal or no damage to the scarf over time.

SUMMARY

A convertible garment is disclosed. The convertible garment comprises a piece of fabric possessing a periphery, and a plurality of fasteners disposed on the piece of fabric along the periphery at substantially regular intervals. One of the plurality of fasteners is configured to fasten to each of the other fasteners to form two armholes. The convertible garment is configured to adopt a first configuration in which the fasteners are not fastened to one another so that the convertible garment is wearable as a scarf. The convertible garment is configured to adopt a second configuration in which the one of the plurality of fasteners is fastened to each of the other fasteners so that the convertible garment is wearable as a vest.

A method of converting a convertible garment is disclosed. The method comprises providing a convertible garment comprising a piece of fabric possessing a periphery and a plurality of fasteners disposed on the piece of fabric along the periphery at substantially regular intervals, one of the three fasteners configured to fasten to each of the other two of the three fasteners to form two armholes, fastening a first one of the plurality of fasteners to a second one of the plurality of fasteners; and fastening the first one of the plurality of fasteners to a third one of the plurality of fasteners so that the convertible garment is wearable as a vest.

BRIEF DESCRIPTION OF THE DRAWINGS

Other features and advantages disclosed herein will become more apparent from the following detailed description of exemplary embodiments when read in conjunction with the attached drawings, wherein.

DETAILED DESCRIPTION

Figure 1A:
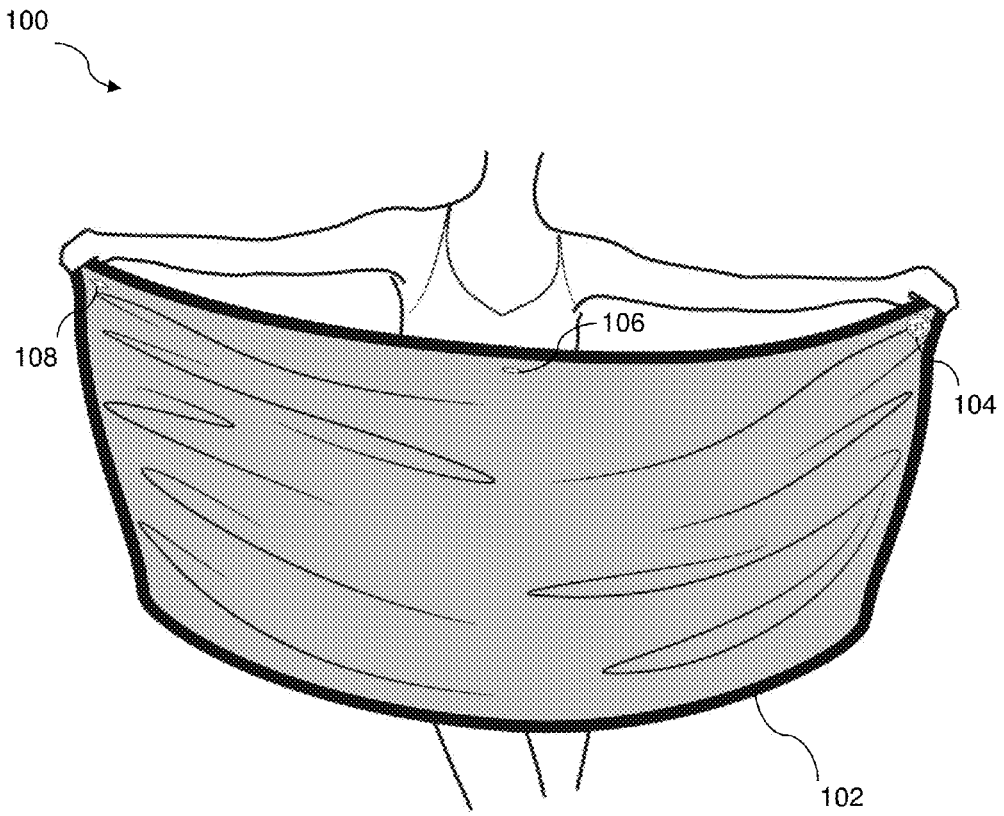
FIG. 1A is a schematic illustration of an exemplary embodiment of a convertible garment in a first configuration in which the convertible garment is wearable as a scarf.
Figure 1B:
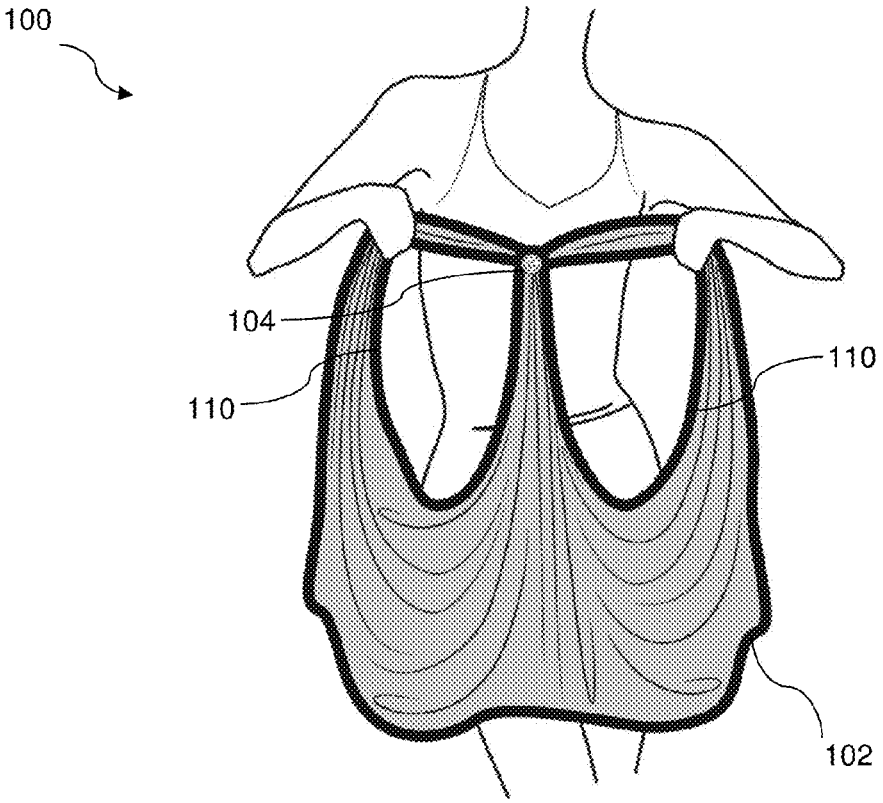
FIG. 1B is a schematic illustration of a an exemplary embodiment of a convertible garment in a second configuration in which the convertible garment is wearable as a vest.

FIGS. 1A-B show an exemplary embodiment of a convertible garment 100 in various configurations. In an exemplary embodiment, the convertible garment 100 includes a piece of fabric 102 possessing a periphery, and a plurality of fasteners, preferably three fasteners 104, 106 and 108, disposed on the piece of fabric 102 along the periphery at substantially regular intervals. One of the three fasteners 104 is configured to fasten to each of the other two fasteners 106 and 108 to form two armholes 110. The convertible garment 100 is configured to adopt a first configuration in which the fasteners 104, 106 and 108 are not fastened to one another so that the convertible garment 100 is wearable as a scarf, as illustrated in FIG. 1A. The convertible garment 100 is configured to adopt a second configuration in which one of the three fasteners 104 is fastened to each of the other two fasteners 106 and 108 so that the convertible garment 100 is wearable as a vest, as illustrated in FIG. 1B.

Exemplary embodiments of the convertible garment 100 can be worn as a scarf and can be converted to a vest in a repeatable manner, without a knot, and with minimal or no damage to the scarf over time.

In exemplary embodiments, the piece of fabric 102 can be formed by one or more types of material and can be assembled in various manners. For example, materials forming the piece of fabric 102 can include, and are not limited to, natural and synthetic textiles, leather-based materials, fiber-based materials, knit materials, woven materials, and/or other nonwoven materials, in any desired combinations. For example, in an illustrative embodiment, a piece of fabric 102 is woven and therefore lends itself to being worn as a vest or as a scarf in warmer weather (e.g., during spring and summer). In another illustrative embodiment, a piece of fabric 102 is knit and therefore lends itself to being worn as a vest or as a scarf in colder weather (e.g., during fall and winter).

In exemplary embodiments, the piece of fabric 102 can be formed by one unfolded layer, one layer that is folded or partially folded over itself, and/or multiple layers.

In an exemplary embodiment, disposing the fasteners 104, 106 and 108 at substantially regular intervals results in armholes 110 that are substantially equal in size. In alternative exemplary embodiments, the fasteners 104, 106 and 108 are disposed at irregular intervals to result in armholes 110 of different sizes. The armholes 110 are large enough for a user's arms to pass through. In other exemplary embodiments, additional fasteners can be provided to vary the size of the armholes 110, or to form additional armhole-like features.

In exemplary embodiments, the fasteners 104, 106 and 108 are disposed along a peripheral edge of the piece of fabric 102 and spaced by three eights of an inch from the periphery. Any other suitable spacing from the periphery can be used.

In exemplary embodiments, the fasteners 104, 106 and 108 include buttons, buttonholes, hooks, loops, threads, and/or any other fasteners known in the art that are suitable to fasten garments. If buttonholes are used, they can be embroidered to provide additional structural integrity.

In alternative embodiments, the convertible garment 100 includes only one fastener, including, but not limited to hooks. This fastener is provided at one location along the periphery of the piece of fabric 102, and is configured to fasten to the piece of fabric 102 itself at one or more separate locations along the periphery of the piece of fabric 102. Alternatively, the convertible garment 100 includes only two fasteners at two separate locations along the periphery of the piece of fabric 102. These fasteners are fastenable to each other and to the piece of fabric 102 itself at a third separate location along the periphery of the piece of fabric 102.

In an exemplary embodiment, the periphery or a portion of the periphery is formed as a stitched turned edge. This can minimize the risk of fraying. Moreover, forming the periphery as a stitched turned edge can help reinforce portions of the periphery that form the armholes 110. In an exemplary embodiment, the stitching is spaced from the edge of the convertible garment 100 by one sixteenth of an inch. Alternatively, the stitching can be spaced from the edge by any desired distance. Alternatively, any type of fabric edge reinforcement known in the art can be used.

FIG. 1A shows an exemplary embodiment of a convertible garment 100 in a first configuration. When the convertible garment 100 is configured in the first configuration, the fasteners 104, 106 and 108 are not fastened to one another so that the convertible garment 100 can be worn as a scarf. For example, a user can don the convertible garment 100 on the user's shoulders and/or around the user's neck.

FIG. 1B shows an exemplary embodiment of a convertible garment 100 in a second configuration. When the convertible garment 100 is configured in the second configuration, one of the three fasteners 104 is fastened to each of the other two fasteners 106 and 108 so that the convertible garment 100 can be worn as a vest. For example, a user can don the convertible garment 100 by positioning each of the armholes 110 so as to surround an arm of the user.

In exemplary embodiments, the piece of fabric 102 is substantially rectangular.

In exemplary embodiments, the periphery of the piece of fabric 102 includes two longitudinal sides and two transverse sides.

In an exemplary embodiment, the piece of fabric 102 is a rectangle that is 27.5 inches in width and 72 inches in length. Any other suitable dimensions can be used.

In exemplary embodiments, the piece of fabric 102 has any desired shape and dimensions suitable for the convertible garment 100 to be worn as a scarf when the fasteners 104, 106 and 108 are not fastened to one another, and to be worn as a vest when the fasteners 104, 106 and 108 are fastened.

In exemplary embodiments, the piece of fabric 102 comprises a first piece of a first material and a second piece of a second material. The first and second materials can be the same material, or can be different materials. The first and second materials can be arranged adjacent to one another, or can be arranged in layers.

In exemplary embodiments, the periphery of the piece of fabric 102 possesses a plurality of sides, and the three fasteners 104, 106 and 108 are all disposed along one of the plurality of sides (i.e., all fasteners are disposed along the same one side).

In exemplary embodiments, the sides are delimited by sharp or rounded corners.

In exemplary embodiments, the three fasteners 104, 106 and 108 comprise a first fastener 106 disposed at a midpoint of the one of the plurality of sides. Disposing the fastener 106 at a midpoint of a side of the convertible garment 100 can help increase the symmetry of the convertible garment 100 in the second configuration.

In exemplary embodiments, the piece of fabric 102 possesses first and second corners, the three fasteners 104, 106 and 108 comprise first and second fasteners 104 and 108, the first fastener 104 is disposed at the first corner, and the second fastener 108 is disposed at the second corner. Disposing the fasteners 104 and 108 at corners of the convertible garment 100 can help increase the symmetry of the convertible garment 100 in the second configuration.

In exemplary embodiments, the one of the three fastener 104 is a button, and each of the other two fasteners 106 and 108 is a buttonhole. In alternative exemplary embodiments, any one of the fasteners 104, 106 and 108 can be a button, and the other two can be buttonholes. Using one button and two buttonholes as the fasteners 104, 106 and 108 can help decrease the number of components needed to manufacture the convertible garment 100, thereby reducing cost and resulting in a more streamlined convertible garment 100 in the first configuration.

In exemplary embodiments, the plurality of fasteners include at least three fasteners.

Figure 2:
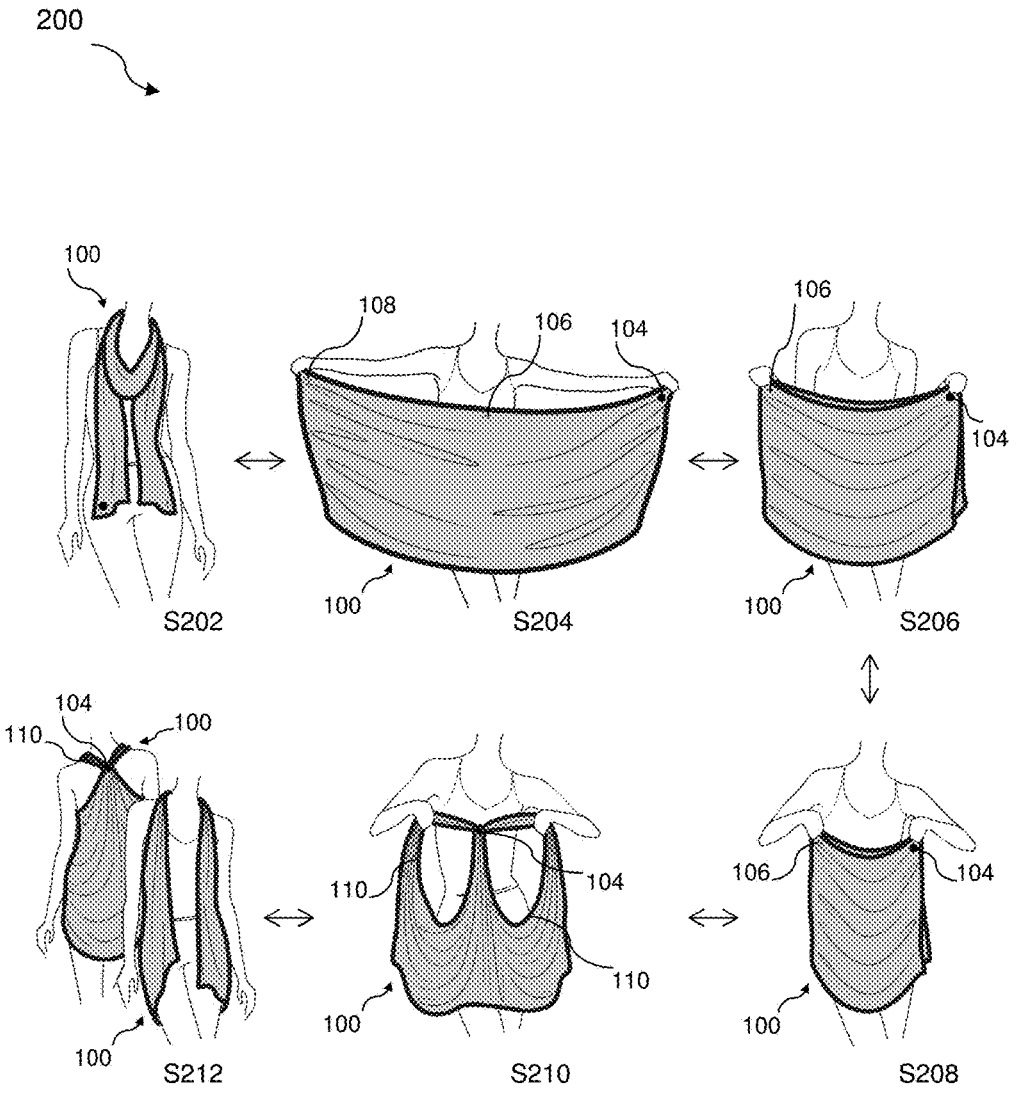
FIG. 2 shows a block diagram of an exemplary method of converting a convertible garment.

FIG. 2 shows a block diagram of an exemplary method 200 of converting the convertible garment 100. At step S202, the convertible garment 100 is wrapped around the user's neck as the user is wearing the convertible garment 100 as a scarf. At step S204, the user holds the convertible garment 100, still wearable as a scarf, at the portions of the periphery at which are disposed two fasteners 104 and 108 configured to fasten to one another. At step S206, the user folds the convertible garment 100 and fastens the two fasteners 104 and 108 together. At step S208, the user folds the convertible garment 100 again and fastens the third fastener 106 to the other two fasteners 104 and 108. At step S210, the user holds the convertible garment 100, now wearable as a vest, by the two armholes 110, thereby allowing the convertible garment 100 drape. At step S212, to wear the convertible garment 100 as a vest, the user positions each of the two armholes 110 of the convertible garment 100 so as to surround an arm of the user, positions at least one of the fasteners 104, 106 and 108 at the back of the user's neck or at the user's upper back, and positions a portion of the convertible garment 100 along the front side of the user.

In an exemplary method, the steps illustrated in FIG. 2 can be performed to convert the convertible garment 100 from a convertible garment 100 worn as a scarf to a convertible garment 100 worn as a vest.

In an exemplary method, each of the steps illustrated in FIG. 2 can be performed in reverse and in reverse order to convert the convertible garment 100 from a convertible garment 100 worn as a vest to a convertible garment 100 worn as a scarf.

It will be appreciated by those skilled in the art that the disclosure herein can be embodied in other specific forms without departing from the spirit or essential characteristics thereof. The presently disclosed embodiments are therefore considered in all respects to be illustrative and not restricted. The scope of the invention is indicated by the appended claims rather than the foregoing description and all changes that come within the meaning and range and equivalence thereof are intended to be embraced therein.

What is claimed is:

1. A convertible garment comprising:

a piece of fabric having a periphery defined by a first and a second opposing longitudinal sides and a first and a second opposing transverse sides, the first and second opposing longitudinal sides being longer than the first and second opposing transverse sides; and a plurality of fasteners consisting only of first and second buttonholes and a button, the plurality of fasteners disposed on the piece of fabric along the periphery at predetermined intervals, the plurality of fasteners all being disposed along the first longitudinal side;

the button configured to be fastened to each of the first and second buttonholes to thereby form two substantially equally sized armholes, the first buttonhole located at a corner of the first longitudinal side and the first transverse side, the second buttonhole located at a midpoint of the first longitudinal side, and the button located at the corner of the first longitudinal side and the second transverse side;

the convertible garment configured to adopt a first configuration in which the fasteners are not fastened to one another so that the convertible garment is wearable as a scarf, and the convertible garment configured to adopt a second configuration in which the button is fastened to each of the first and second buttonholes to form the two armholes, each of the two substantially equally sized armholes configured to each receive an arm of a user so that the convertible garment is wearable as a vest on both shoulders of the user.

2. The convertible garment of claim 1, wherein the piece of fabric is rectangular.

3. The convertible garment of claim 1, wherein the piece of fabric comprises a first piece of a first material and a second piece of a second material.

4. A method of converting a convertible garment comprising:

providing a convertible garment comprising a piece of fabric having a periphery defined by a first and a second opposing longitudinal sides and a first and a second opposing transverse sides, the first and second opposing longitudinal sides being longer than the first and second opposing transverse sides, the piece of fabric possessing a periphery and a plurality of fasteners consisting only of first and second buttonholes and a button, the plurality of fasteners disposed on the piece of fabric along the periphery at predetermined intervals, the button configured to fasten to each of the first and second buttonholes to form two substantially equally sized armholes, the first buttonhole located at a corner of the first longitudinal side and the first transverse side, the second buttonhole located at a midpoint of the first longitudinal side, and the button located at the corner of the first longitudinal side and the second transverse side, wherein the button is not fastened to the first and second buttonholes, such that the convertible garment is wearable as a scarf;

fastening the button to the first buttonhole; and fastening the button to the second buttonhole so that the convertible garment is wearable as a vest.

5. The method of converting a convertible garment of claim 4, further comprising:

positioning each of the two armholes of the convertible garment so as to surround an arm of a user;

positioning at least one of the plurality of fasteners at the back of the user's neck or at the user's upper back; and positioning a portion of the convertible garment along the front side of the user.

6. The convertible garment of claim 1, wherein the plurality of fasteners are all disposed only along the first longitudinal side.

* * * * *